US006761092B2

(12) United States Patent
Hsien

(10) Patent No.: US 6,761,092 B2
(45) Date of Patent: Jul. 13, 2004

(54) METAL PIECE ATTRACTION DEVICE ON RATCHET TOOL

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/289,274

(22) Filed: Nov. 7, 2002

(65) Prior Publication Data

US 2004/0089110 A1 May 13, 2004

(51) Int. Cl.[7] ..... B25B 13/46
(52) U.S. Cl. ..... 81/63.2; 81/58; 81/125
(58) Field of Search ..... 81/60–63.2, 58–58.5, 81/59.1, 13, 125, 176.2

(56) References Cited

U.S. PATENT DOCUMENTS 3,731,722 A * 5/1973 Carr ..... 81/451
4,738,168 A * 4/1988 Carminati ..... 81/125
5,307,713 A * 5/1994 White ..... 81/180.1
5,544,555 A * 8/1996 Corley et al. ..... 81/125
6,101,902 A * 8/2000 Wei ..... 81/63
6,164,166 A * 12/2000 Whiteford ..... 81/63.1
6,481,315 B1 * 11/2002 Chang et al. ..... 81/60
2003/0041699 A1 * 3/2003 Chen ..... 81/125

* cited by examiner

*Primary Examiner*—Joseph J. Hail, III
*Assistant Examiner*—David B. Thomas

(57) ABSTRACT

A ratchet tool includes a head and an engaging member is rotatably received in a hole of the head. The engaging member has a polygonal inner periphery for engaging a nut and a toothed outer periphery which is engaged with a pawl movably connected to the head. A magnetic member is connected to a side of the engaging member and protrudes into a space enclosed by the polygonal inner periphery of the engaging member. A ring is mounted to the engaging member and the magnetic member is connected to the ring and the engaging member. The nut is engaged with the engaging member and attracted to the magnetic member and is easily to removed by rotating the ring.

2 Claims, 4 Drawing Sheets

METAL PIECE ATTRACTION DEVICE ON RATCHET TOOL

FIELD OF THE INVENTION

The present invention relates to a ratchet tool that has a ring-shaped magnetic member connected to a side of the engaging member so as to attract a metal piece after the metal piece is loosened.

BACKGROUND OF THE INVENTION

A conventional hand tool such as a wrench or a ratchet tool, generally includes a head with an engaging member rotatably received therein. The engaging member has a polygonal inner periphery for engaging an object such as a nut or a head of a bolt. There is a ratchet mechanism received in the ratchet tool so as to control the direction of the engaging member. The engaging member is rotated with the handle of the tool when the ratchet mechanism is set in one direction so as to output a torque to loosen or tighten the object. When the ratchet mechanism is set to the other direction, the engaging member is remained still while the handle is rotated. The ratchet tool is convenient to loosen the tightened object. However, after the object is loosened, the ratchet mechanism of the ratchet tool is not that convenient because the handle has to be rotated about the object again and again to remove the nut from a threaded rod. Most of the users will put the ratchet tool aside and spin the nut by fingers. In some situations, the nut could be attached by contaminated oil or grease, or it is hot that the fingers could be burn.

The present invention intends to provide a ratchet tool that has a magnetic member connected to a side of the engaging member such that the nut can be attracted by the magnetic member without touch by fingers.

SUMMARY OF THE INVENTION

In accordance with one aspect of the present invention, there is provided a ratchet tool which comprises a head having a hole and an engaging member is rotatably received in the hole. The engaging member has a polygonal inner periphery and a toothed outer periphery. A pawl is movably connected to the head and has a toothed side which is engaged with the toothed outer periphery of the engaging member. A magnetic member is connected to a side of the engaging member and protrudes into a space enclosed by the polygonal inner periphery of the engaging member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
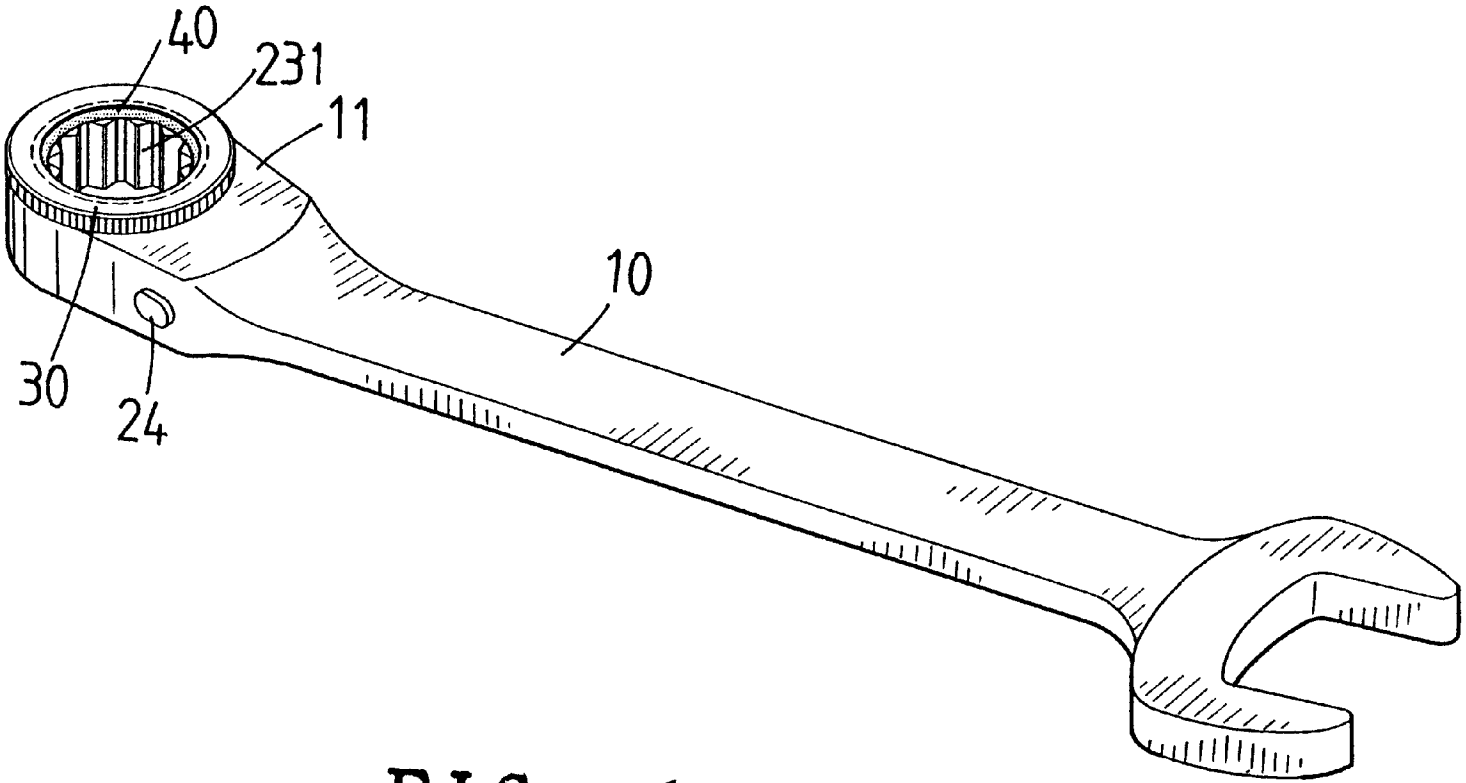
FIG. 1 is a perspective view to show the ratchet tool of the present invention.
Figure 2:
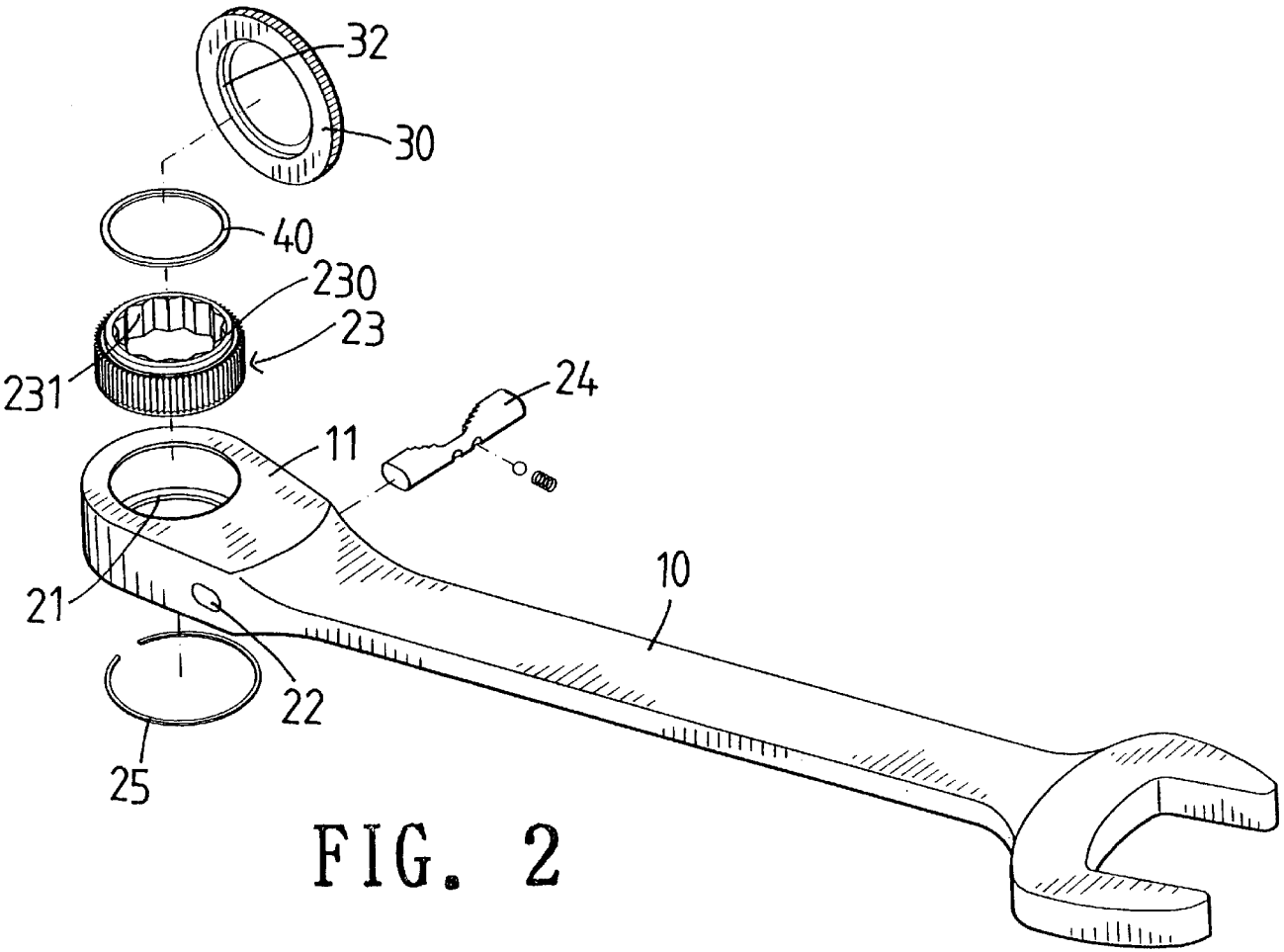
FIG. 2 is an exploded view to show the magnetic member, the engaging member and the ring of the ratchet tool of the present invention.
Figure 3:
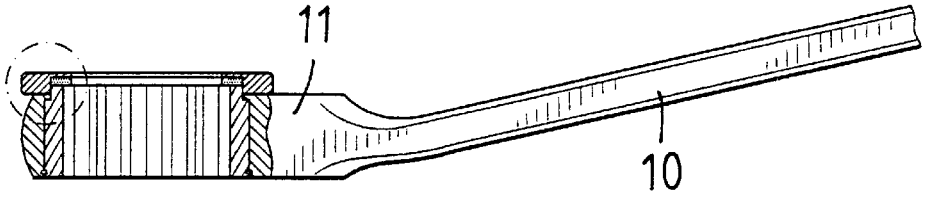
FIG. 3 is a side cross sectional view to show the engagement of the magnetic member, the engaging member and the ring of the ratchet tool of the present invention.
Figure 4:
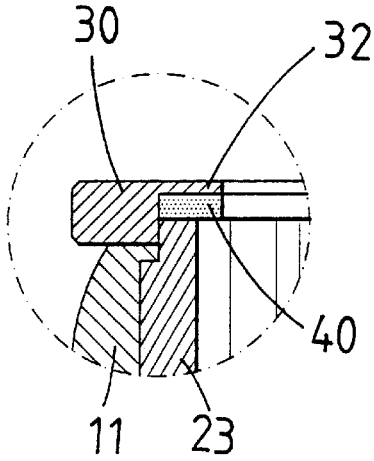
FIG. 4 is an enlarged view to show the engagement of the magnetic member, the engaging member and the ring of the ratchet tool of the present invention.

Referring to FIGS. 1 to 4, the ratchet tool 10 of the present invention comprises a head 11 and a handle wherein the head 11 has a hole 21 and an engaging member 23 is rotatably received in the hole 21. The engaging member 23 has a polygonal inner periphery 231 and a toothed outer periphery. The head 11 has a passage 22 defined therethrough and a tubular pawl 24 is movably received in the passage 22 of the head 11. One of two ends of the pawl 24 extends out from one of the two open ends of the passage 22 so that the user may push the pawl 24 to shift it. The pawl 24 has a toothed side which is engaged with the toothed outer periphery of the engaging member 23. The engaging member 23 has an annular flange 230 extending from a side thereof and a magnetic member 40 is connected to the annular flange 230. The magnetic member 40 protrudes into a space enclosed by the polygonal inner periphery 231 of the engaging member 23.

A ring 30 is mounted to annular flange 230 and has a flange 32 extending from an inner periphery thereof. The magnetic member 40 is located between the flange 32 of the ring 30 and the annular flange 230 of the engaging member 23. The magnetic force makes the ring 30, the magnetic member 40 and the engaging member 23 as a one-piece member.

Figure 5:
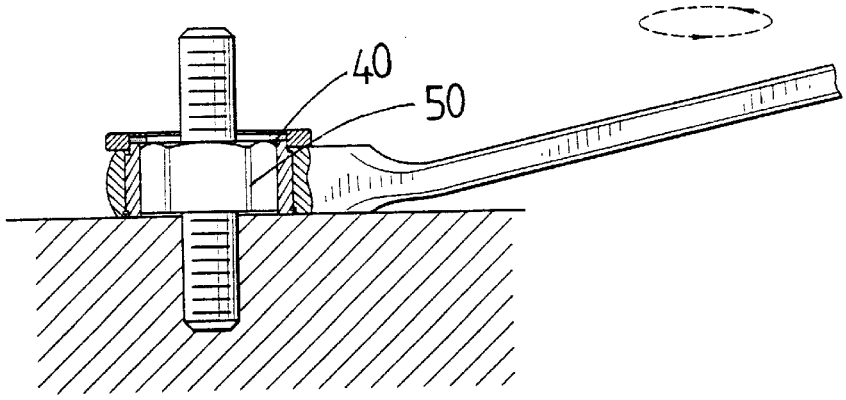
FIG. 5 shows a nut on a threaded rod is engaged by the engaging member of the ratchet tool of the present invention.
Figure 6:
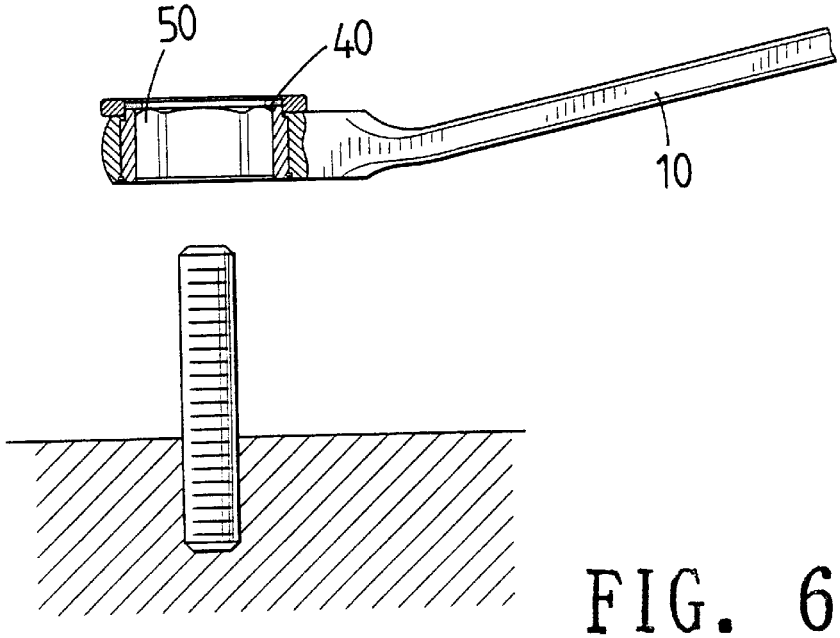
FIG. 6 shows the nut is attracted by the magnetic member in the head of the ratchet tool of the present invention.

As shown in FIGS. 5 and 6, after the nut 50 is loosened on a threaded rod by engaging the nut 50 with the engaging member 23, the user may rotate the ring 30 to quickly remove the nut 50 from the threaded rod and the nut 50 is attracted by the magnetic member 40 without using fingers of the user to remove the nut 50 from the threaded rod.

While we have shown and described the embodiment in accordance with the present invention, it should be clear to those skilled in the art that further embodiments may be made without departing from the scope of the present invention.

What is claimed is:

1. A ratchet tool comprising:

a head having a hole and an engaging member rotatably received in the hole, the engaging member having a polygonal inner periphery and a toothed outer periphery, an annular flange located on a side of the engaging member;

a ring having a flange extending from an inner periphery thereof and mounted to the annular flange on the engaging member;

a pawl movably connected to the head and having a toothed side which is engaged with the toothed outer periphery of the engaging member, and a magnetic member connected to the engaging member and located between the flange of the ring and the annular flange of the engaging member, the magnetic member protruding into a space enclosed by the polygonal inner periphery of the engaging member.

2. The ratchet tool as claimed in claim 1, wherein the head has a passage defined therethrough and the pawl is movably engaged with the passage, one of two ends of the pawl extending out from one of the two open ends of the passage.

* * * * *